US008820885B2

(12) United States Patent
Hildebrand et al.

(10) Patent No.: US 8,820,885 B2
(45) Date of Patent: Sep. 2, 2014

(54) PRINTHEAD HAVING APERTURES FOR APPLICATION OF A SURFACE TREATMENT FLUID

(71) Applicant: Xerox Corporation, Norwalk, CT (US)

(72) Inventors: Greg A. Hildebrand, Keizer, OR (US); Cory D. Luth, Wilsonville, OR (US); Jeffrey J. Folkins, Rochester, NY (US); Jeffrey S. Rigotti, West Linn, OR (US); Srinivasa R. Deshiikan, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/680,343

(22) Filed: Nov. 19, 2012

(65) Prior Publication Data

US 2014/0139587 A1 May 22, 2014

(51) Int. Cl.
*B41J 2/165* (2006.01)
*B41J 2/14* (2006.01)

(52) U.S. Cl.
CPC ..... *B41J 2/16552* (2013.01); *B41J 2/14201* (2013.01)
USPC ..... 347/28

(58) Field of Classification Search
CPC ..... B41J 2/165; B41J 2/015; B41J 2/16552; B41J 2/14201
USPC ..... 347/22, 28, 33, 74, 128
See application file for complete search history.

(56) References Cited

U.S. PATENT DOCUMENTS

| | | | | |
|---|---|---|---|---|
| 5,230,926 | A | 7/1993 | Narang et al. | |
| 5,790,146 | A | 8/1998 | Anderson | |
| 6,267,464 | B1 * | 7/2001 | Furlani et al. | 347/27 |
| 6,737,109 | B2 | 5/2004 | Stanton et al. | |
| 6,913,338 | B2 * | 7/2005 | Rhoads et al. | 347/28 |
| 7,311,378 | B2 | 12/2007 | Fujimori et al. | |
| RE40,294 | E | 5/2008 | Rhoads et al. | |
| 7,556,342 | B2 | 7/2009 | Hamano | |
| 8,091,980 | B2 | 1/2012 | Snyder et al. | |
| 2006/0268050 | A1 | 11/2006 | Sonobe | |
| 2007/0126783 | A1 | 6/2007 | Deshon-Stepp et al. | |
| 2011/0189918 | A1 | 8/2011 | Zhao et al. | |

* cited by examiner

*Primary Examiner* — Alessandro Amari
*Assistant Examiner* — Michael Konczal
(74) *Attorney, Agent, or Firm* — Maginot, Moore & Beck, LLP

(57) ABSTRACT

A printhead enables surface treatment fluid to be applied to the face of the printhead through at least one aperture located in the printhead faceplate. The printhead receives pressurized surface treatment fluid, which flows through a reservoir in the printhead, through at least one channel in the jet stack, and out the at least one aperture onto the surface of the faceplate. The surface treatment fluid is spread across ink apertures in the faceplate to disable ink from drooling from the ink apertures.

10 Claims, 5 Drawing Sheets

PRINTHEAD HAVING APERTURES FOR APPLICATION OF A SURFACE TREATMENT FLUID

TECHNICAL FIELD

This disclosure relates generally to inkjet imaging devices, and, in particular, to printheads in inkjet imaging devices.

BACKGROUND

In general, inkjet printing machines or printers include at least one printhead that ejects drops of liquid ink onto a recording or image forming medium. A phase-change inkjet printer employs phase change inks that are solid at ambient temperature, but transition to a liquid phase at an elevated temperature. The melted ink can then be ejected from a printhead to form an ink image on an image receiving member. The ink image may be formed on a layer of release agent coating an intermediate imaging member, such as a rotating drum or belt, and then transferred to an image receiving substrate, such as a sheet of paper, as the substrate passes through a nip formed between a transfix roller and the intermediate imaging member. In other printing systems, the ink can be ejected directly onto printing media directed past the printheads.

Printers typically conduct various maintenance operations to ensure proper operation of the inkjets in each printhead. One known maintenance operation removes particles or other contaminants within a printhead by urging ink through some or all of the inkjets in the printhead. This purged ink flows from the apertures of the inkjets that are located in a faceplate of each printhead onto the faceplate. The ink rolls downwardly under the effect of gravity to an ink drip bib mounted at the lower edge of the faceplate or onto a flexure chute mounted on a maintenance station. The drip bib or flexure chute is configured to collect the liquid ink and direct the ink into an ink receptacle. In some printers, one or more wipers are manipulated to contact the faceplate of each printhead and wipe the purged ink toward the drip bib to facilitate the collection and removal of the purged ink. Alternatively, in systems where the printhead faces downwardly, some of the ink from a purge remains on the surface of the faceplate due to ink surface tension. This remaining ink can also be removed with a wiper passing across the faceplate.

Inkjet printheads are typically coated with a hydrophobic material, for example polytetrafluoroethylene, to maintain a low surface energy on the printhead face to enable ink on a printhead to run off the printhead face, but also to keep the ink held within the apertures from leaking, flowing, or drooling onto the surface of the printhead face. However, over time the hydrophobic coating on the printheads can wear off and the surface energy of the printhead face increases. The increased surface energy can result in ink adhering to the printhead faceplate near the apertures during printing or after purging, which can result in interference with subsequent jetting from the apertures. Typically, the ink in the printhead is held at a negative static pressure (as measured at the apertures) to disable the ink from flowing onto the faceplate. In addition, the low surface energy of the faceplate surface helps prevent the ink in the apertures from flowing or drooling out of the head and onto the faceplate surface, where the presence of the ink can interfere with jetting performance. Thus, increased surface energy of the faceplate surface reduces the ability of the apertures to retain ink, increases ink drooling, and increases the need for the negative static pressure within the apertures. This increase in pressure can reduce the performance latitude of the printhead.

In some printers, a surface treatment fluid is applied to the face of the printhead to reduce the surface energy of the printhead faceplate. Surface treatment fluid is typically applied by manually wiping the printhead face with an applicator bearing a surface treatment fluid. Manual application of surface treatment fluid, however, often leaves a non-uniform layer and amount of surface treatment fluid, and may inadvertently damage the printhead face. Additionally, loss of productivity occurs while the printer is off line to apply the treatment fluid. Improved surface treatment of printheads is therefore desirable.

SUMMARY

In one embodiment a printhead enables surface treatment fluid to be applied to the surface of a printhead faceplate through at least one aperture located in the faceplate. The printhead includes a faceplate, which has at least one first aperture and a second plurality of apertures, and a jet stack, which has at least one first channel and a second plurality of channels. The at least one first channel is fluidly and independently connected to the at least one first aperture in the faceplate in a one-to-one correspondence, and the second plurality of channels are fluidly and independently connected to the second plurality of apertures in the faceplate. Each channel in the second plurality of channels includes an inkjet ejector configured to eject a fluid through the aperture fluidly connected to the channel associated with the inkjet ejector, while none of the channels in the at least one first channel have an inkjet ejector.

In another embodiment a printer includes a printhead that enables surface treatment fluid to be applied to the surface of a printhead faceplate through at least one aperture located in the faceplate. The printer includes a printhead, a pressure source, and a controller. The printhead includes a faceplate, which has a first plurality of apertures and a second plurality of apertures, and a jet stack, which has a first plurality of channels and a second plurality of channels. The first plurality of channels is fluidly and independently connected to the first plurality of apertures in the faceplate in a one-to-one correspondence, and the second plurality of channels are fluidly and independently connected to the second plurality of apertures in the faceplate. Each of the channels in the second plurality of channels has an inkjet ejector configured to eject a fluid through the aperture fluidly connected to the channel associated with the inkjet ejector, while none of the channels in the first plurality of channels have an inkjet ejector. The pressure source is fluidly connected to each of the channels in the first plurality of channels and the controller is operatively connected to the pressure source. The controller is configured to operate the pressure source selectively to move fluid through the first plurality of channels and out of the first plurality of apertures to place fluid on the faceplate.

In yet another embodiment, an in situ method of maintaining a printhead enables application of surface treatment fluid to a surface of a faceplate on the printhead. The method includes expelling a first fluid from a first plurality of apertures in a first area of the faceplate of the printhead to place the first fluid on the faceplate of the printhead, with none of the apertures in the first plurality of apertures being associated with an inkjet ejector. The method further includes wiping the faceplate to spread the first fluid across a second area of the faceplate in which a second plurality of apertures are positioned, the second plurality of apertures being fluidly connected to a source of a second fluid, which is different than the first fluid, and each of the apertures in the first plurality of apertures being independently configured with an inkjet ejector to eject the second fluid.

DETAILED DESCRIPTION

Figure 1:
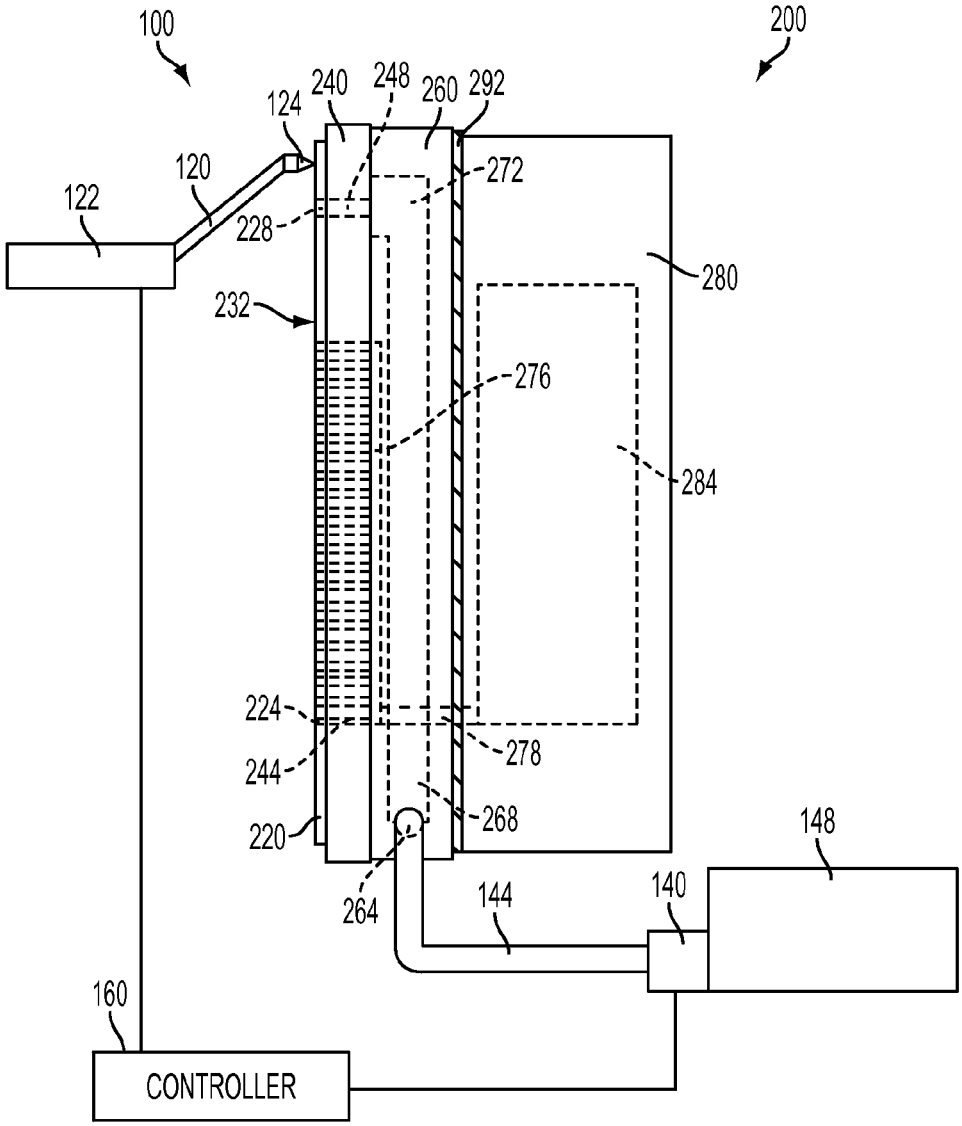
FIG. 1 is a side view of a printing system.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form that are rendered and used to operate inkjet ejectors to form an ink image on the print media. These data may include text, graphics, pictures, and the like. The operation of producing images with colorants on print media, for example, graphics, text, photographs, and the like, is generally referred to herein as printing or marking. Some inkjet printers use phase-change ink, also referred to as a solid ink, which is in a solid state at room temperature but melts into a liquid state at a higher operating temperature. Other inkjet printers use aqueous ink, emulsified ink, gel ink, UV curable ink, or other inks that are in a liquid state under operating conditions.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

FIG. 1 illustrates a printing system 100 for use in an inkjet printer. The printing system includes a wiper arm 120, an external reservoir 148, a pump 140, and a printhead 200. A wiper blade 124, which can be formed of an elastomer such as urethane, silicone, rubber, or any other suitable material, is connected to the wiper arm 120. The wiper arm 120 is operatively connected to an actuator 122 to enable the wiper blade 124 to be moved from a position out of contact with the surface 232 of the printhead 200 to a position in which the wiper blade engages the surface 232. After the wiper blade 124 contacts the surface 232, the actuator translates the wiper arm 120 downwardly to move the wiper blade 124 along the surface 232 of the printhead 200 to urge any remaining ink off the printhead 200 and to spread surface treatment fluid across the surface 232 of the printhead 200. After the wiper reaches a position at or near a bottom of the printhead surface 232, the actuator moves the wiper to disengage the wiper from the surface 232 and to the position out of contact with the surface. As used herein, the term "surface treatment fluid" is used to refer to a fluid other than ink that is applied to the face of the printhead. In some embodiments, the surface treatment fluid is silicone oil, though different surface treatment fluids can be applied to the printhead face in other embodiments.

The external reservoir 148 is configured to store a volume of surface treatment fluid for supply to the printhead 200. The pump 140 is operatively connected to the external reservoir 148 and configured to move the treatment fluid from the external reservoir 148, through tube 144, and into the printhead 200. The pump can be a gear pump, a peristaltic pump, or any other pump suitable for moving the surface treatment fluid from the external reservoir 148 to the printhead 200. In other embodiments, the external reservoir includes a pneumatic pressure source in place of a pump to pressurize air in the external reservoir and force the fluid therein to flow to the printhead. In some embodiments, a single external reservoir can be configured to supply treatment fluid to a plurality of printheads.

Operation and control of the various subsystems, components and functions of the wiper arm and pump are performed with the aid of the controller 160. The controller 160 is operatively connected to the actuator 122 that moves wiper arm 120 to enable the controller to maneuver the wiper blade to wipe the surface 232 of the printhead 200. The controller is also operatively connected to the pump 140 to enable the controller to activate the pump 140 to move the surface treatment fluid from the external reservoir 148 through the printhead 200. The controller 160 can be implemented with general or specialized programmable processors that execute programmed instructions. The instructions and data required to perform the programmed functions are stored in memory associated with the processors or controllers. The processors, their memories, and interface circuitry configure the controller 160 to perform the functions and processes described herein. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Figure 2:
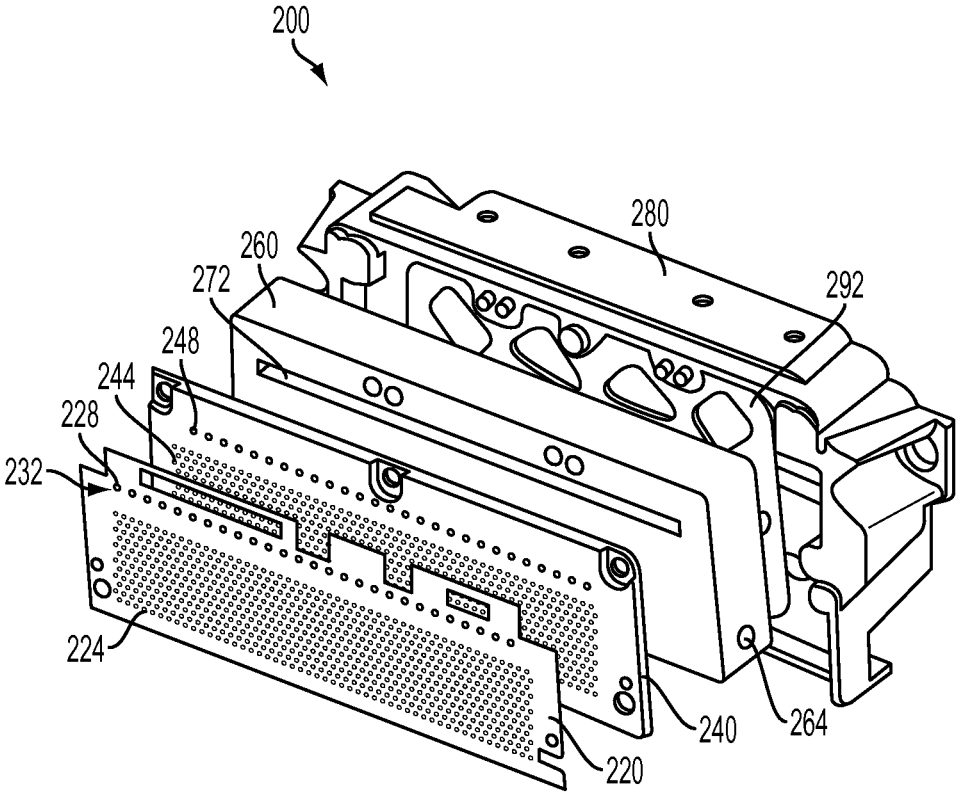
FIG. 2 is an exploded perspective view of the printhead of the printing system of FIG. 1.

With reference to FIG. 2 and continuing reference to FIG. 1, the printhead 200 comprises a faceplate 220, a jet stack 240, an internal reservoir 260, and an ink reservoir 280. The faceplate 220 includes an external surface 232 having a plurality of surface treatment fluid apertures 228 arranged in a line in the cross-process direction across the faceplate 220. The apertures 228 are configured to emit a surface treatment fluid onto the surface 232 of the faceplate. In the illustrated embodiment, the apertures are circular, though in other embodiments any suitable geometry and size can be used for the apertures, and the faceplate can include any suitable number of apertures, such as one or more elongated slots. The faceplate 220 further includes an array of inkjet apertures 224 located on the faceplate 220 beneath the surface treatment fluid apertures 228. The inkjet apertures 224 are configured to enable ink to be ejected from inkjet ejectors located in the jet stack 240 onto a media sheet or image receiving member positioned proximate to the surface 232 of the faceplate 220.

The jet stack 240, which is formed of a plurality of substrates affixed together with adhesives, is bonded to the side of the faceplate 220 opposite the surface 232. The jet stack 240 includes a plurality of surface treatment fluid channels 248 extending through the plurality of layers, each of which fluidly connects one of the treatment fluid apertures 228 with the internal reservoir 260. In addition, a plurality of ink channels 244 are defined in the jet stack, each of which fluidly connects one of the ink apertures 224 with an ink manifold 276. Each of the ink channels 244 includes an inkjet ejector, which can be, for example, a piezoelectric actuator or a thermal transducer. The inkjet ejectors are configured to eject ink from the associated aperture 224 onto a media sheet or an intermediate imaging member positioned proximate to the surface 232 of the printhead 200 in response to firing signals generated by a print engine controller, which, in some embodiments, is integrated with controller 160.

The internal reservoir 260 is bonded to the side of the jet stack 240 opposite the faceplate 220. The internal reservoir 260 includes a fluid inlet port 264, a fluid storage chamber 268, a treatment fluid manifold 272, an ink manifold 276, and an ink supply conduit 278. The fluid inlet port 264 is configured to be fluidly connected to the external reservoir 148 and to receive surface treatment fluid, pressurized by either the pump 140 or a pneumatic pressure source (not shown), from the external reservoir 148 via the tube 144. The fluid inlet port 264 delivers the surface treatment fluid into the fluid storage chamber 268, which is defined inside the internal reservoir 260 and is configured to store a volume of the surface treatment fluid within the printhead 200. The fluid storage chamber 268 opens to a treatment fluid manifold 272, through which the surface treatment fluid flows from the storage chamber 268 to the channels 248 in the jet stack 240. The ink supply conduit 278 passes through the internal reservoir 260, but is fluidly isolated from the fluid storage chamber 268, to enable ink to flow from the ink reservoir 280 to the ink manifold 276 for ejection from the inkjet ejectors. Although the embodiment illustrated in FIG. 1 depicts the ink manifold 276 within the internal reservoir 260, in other embodiments the ink manifold can be located within the jet stack, or the inkjets can be fluidly connected to the ink reservoir without an ink manifold.

The ink reservoir 280 is attached to the end of the internal reservoir 260 opposite the jet stack 240. In some embodiments, depending on the temperature of the ink and the thermal characteristics of the surface treatment fluid, a thermally insulating layer 292 can be positioned between the ink reservoir 280 and the internal reservoir 260 to reduce the flow of heat between the ink reservoir 280, which can be heated in some printheads, and the internal reservoir 260 to enable the treatment fluid to maintain a temperature and viscosity within a predetermined range appropriate for treatment of the printhead surface 232. In other embodiments, the insulation can be positioned about the treatment fluid storage chamber and the treatment fluid manifold. The ink reservoir 280 includes an ink storage chamber 284, which stores a volume of ink for delivery through the ink supply conduit 278 to the ink manifold 276.

The printer in which the printing system 100 is installed periodically performs maintenance operations to keep the printhead operating optimally. As part of the printhead maintenance, the surface 232 of the faceplate 220 may require application of surface treatment fluid at various intervals to prevent ink from drooling from the ink apertures 224 or adhering to the printhead faceplate 220. When application of surface treatment fluid is required, the controller 160 generates a signal to activate the pump 140 or the pneumatic pressure source in the external reservoir 148 to move the surface treatment fluid from the external reservoir 148, through the tube 144, and into the internal reservoir 260 via the inlet port 264. The pressurized treatment fluid is forced through the treatment fluid manifold 272, through the fluid channels 248, so the fluid flows from the fluid apertures 228 onto the surface 232 of the faceplate 220. The controller 160 determines the rate of flow of the treatment fluid from the apertures 228 by controlling the speed of the pump or the pressure provided by the pneumatic pressure source. After a predetermined amount of time has passed, the controller 160 deactivates the pump 140 to stop the flow of treatment fluid from the apertures 228 and activates the actuator 122 to move the wiper arm 120 and the wiper blade 124 attached to the arm into contact at a position on the surface 232 of the faceplate 220 that enables the wiper blade to sweep over the surface treatment fluid apertures 228. The controller then operates the actuator to move the wiper 120 downwardly past the treatment fluid apertures 228, wiping the surface 232 and then the ink apertures 224. The wiper blade 124 smears the surface treatment fluid on the surface 232, spreading the fluid evenly across the surface 232 and the ink apertures 224, and urging excess treatment fluid off the bottom of the faceplate 220, where the fluid flows into an ink waste collection system (not shown). Upon reaching the bottom of the faceplate 220, the controller 160 operates the wiper actuator 122 to move the wiper arm 120 to disengage the wiper blade 124 from the surface 232. In some embodiments, the controller can be configured to operate the wiper and the source of surface treatment fluid to apply the treatment fluid and wipe the surface of the faceplate multiple times to increase the uniformity of the layer of surface treatment fluid spread across the faceplate or to more accurately control the amount of fluid on the faceplate.

Figure 3:
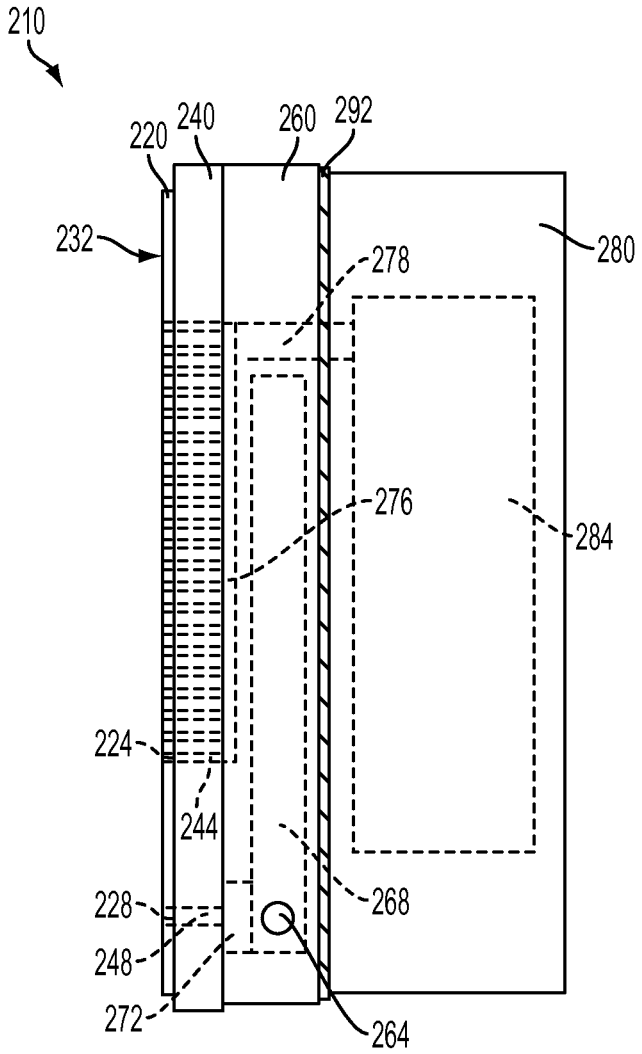
FIG. 3 is a side view of another embodiment of a printhead.

FIG. 3 illustrates another embodiment of a printhead 210. The printhead includes a faceplate 220, a jet stack 240, an internal reservoir 260, and an ink reservoir 280. The faceplate 220 has a flat external surface 232, a plurality of surface treatment fluid apertures 228 arranged in a line in the cross-process direction across the faceplate 220 and an array of inkjet apertures 224 located on the faceplate 220 above the surface treatment fluid apertures 228. The inkjet apertures 224 are configured to enable inkjet ejectors located in the jet stack 240 to eject ink onto a media sheet or image receiving member positioned proximate to the surface 232 of the faceplate 220.

The jet stack 240, which is formed of a plurality of brazed plates and adhesive layers affixed together, is bonded to the side of the faceplate 220 opposite the surface 232. The jet stack 240 includes a plurality of surface treatment fluid channels 248 extending through the jet stack 240, each of the fluid channels 248 fluidly connecting one of the treatment fluid apertures 228 with the internal reservoir 260. In addition, a plurality of ink channels 244 are defined in the jet stack, each ink channel fluidly connecting one of the ink apertures 224 with the ink reservoir 280. Each of the ink channels 244 includes an inkjet ejector, which is configured to eject ink from the associated aperture 224 onto a media sheet or an intermediate imaging member in response to firing signals received from a print engine controller.

The jet stack 240 is bonded to the internal reservoir 260 on the side opposite the faceplate 220. The internal reservoir 260 includes a fluid inlet port 264, a fluid storage chamber 268, a treatment fluid manifold 272, an ink manifold 276, and an ink supply conduit 278. The fluid inlet port 264 is configured to be fluidly connected to an external reservoir, such as the reservoir 148 of FIG. 1, to receive pressurized surface treatment fluid. The fluid inlet port 264 delivers the surface treatment fluid into the fluid storage chamber 268, which is defined inside the internal reservoir 260 and is configured to store a volume of the surface treatment fluid within the printhead 210. The fluid storage chamber 268 opens to the treatment fluid manifold 272, through which the surface treatment fluid flows from the storage chamber 268 to the channels 248 in the jet stack 240. The ink supply conduit 278 is located above the fluid storage chamber 268, fluidly isolated from the fluid storage chamber 268, to enable ink to flow from the ink reservoir 280 through the internal reservoir 260 to be stored in the ink manifold 276 until the ink is ejected by the inkjet ejectors through the ink apertures 224 in the faceplate 220.

The ink reservoir 280 is attached to the side of the internal reservoir 260 opposite the jet stack 240. A thermally insulating layer 292 is disposed between the ink reservoir 280 and the internal reservoir 260 to impede the flow of heat between the ink reservoir 280 and the internal reservoir 260. The ink reservoir 280 includes an ink storage chamber 284, which stores a volume of ink for delivery through the ink supply conduit 278 to the inkjets in the jet stack 240.

The embodiment of FIG. 3 operates in a similar manner to the embodiment of FIGS. 1 and 2. However, a controller operating a wiper actuator in the system moves the wiper arm to contact the lower portion of the printhead, below the treatment fluid apertures 228, and wipe upwardly to spread the surface treatment fluid over the surface 232 of the faceplate 220 and the inkjet apertures 224. The controller can also be configured to move the wiper blade into contact with the surface 232 of the printhead 210 prior to pressurizing the surface treatment fluid to enable the wiper blade to capture treatment fluid flowing down the faceplate 220.

Figure 4:
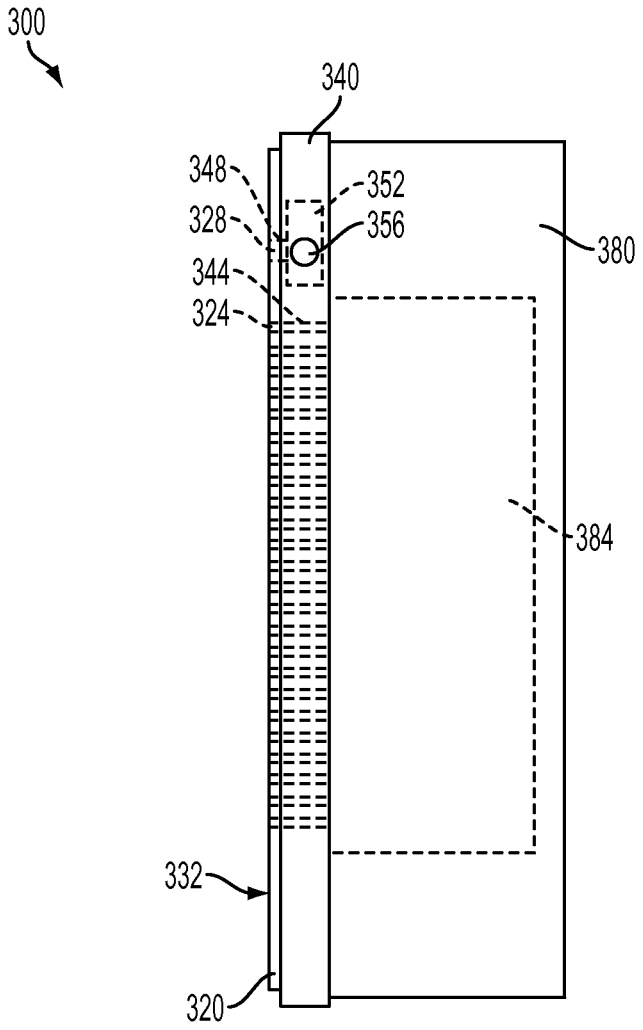
FIG. 4 is a side view of yet another embodiment of a printhead.
Figure 5:
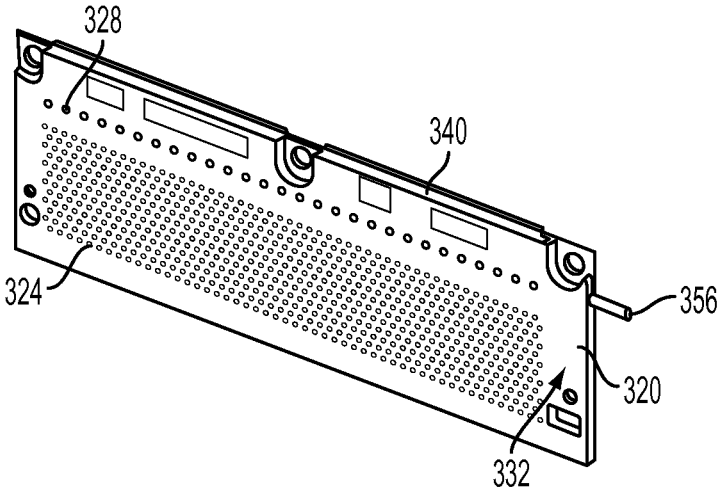
FIG. 5 is a perspective view of the jet stack and aperture plate of the printhead of FIG. 4.

FIGS. 4 and 5 illustrate another printhead 300 for use in a printing system like the one shown in FIG. 1. The printhead 300 has a faceplate 320, a jet stack 340, and an ink reservoir 380. The faceplate 320 includes an external surface 332, a plurality of surface treatment fluid apertures 328 arranged in a line in the cross-process direction across the faceplate 320, and an array of ink apertures 324 located on the faceplate 320 beneath the surface treatment fluid apertures 328. The ink apertures 324 are configured to enable ink to be ejected from inkjet ejectors located in the jet stack 340 onto a media sheet or image receiving member positioned proximate to the surface 332 of the faceplate 320.

The jet stack 340, which is formed of a plurality of substrates and adhesives affixed together, is bonded to the side of the faceplate 320 opposite the surface 232. The jet stack 340 includes a plurality of surface treatment fluid channels 348, a plurality of ink channels 344, a treatment fluid inlet port 356, and a treatment fluid manifold 352. The surface treatment fluid channels 348 extend from the faceplate 320 into the jet stack 340, each being configured to fluidly connect one of the treatment fluid apertures 328 with the treatment fluid manifold 352. The inlet port 356 is configured to be fluidly connected to an external reservoir, such as the external reservoir 148 of FIG. 1, to enable the inlet port 356 to receive surface treatment fluid. The inlet port 356 is fluidly connected to the treatment fluid manifold 352, which is configured to store a volume of treatment fluid until a pressure is applied to the fluid to expel the treatment fluid through the fluid channels 348 and apertures 328 onto the surface 332 of the faceplate.

The plurality of ink channels 344 are defined in the jet stack 340, each fluidly connecting one of the ink apertures 324 with an ink reservoir chamber 384 in the ink reservoir 380. Each of the ink channels 344 includes an inkjet ejector, which is configured to eject ink from the associated aperture 324 onto a media sheet or an intermediate imaging member in response to firing signals received from a print engine controller.

The ink reservoir 380 is bonded to the side of the jet stack 340 opposite the faceplate 220. The ink reservoir chamber 384 is defined in the ink reservoir 380 and is configured to store a volume of ink until the ink is drawn into the ink channels 344 for ejection from the inkjet ejectors.

The printhead 300 of FIGS. 4 and 5 operates substantially identical to the embodiment of FIGS. 1 and 2 described above. The treatment fluid is pressurized by, for example, a pump such as the pump 140 of FIG. 1. Treatment fluid then flows into the inlet port 356 from a reservoir, such as external reservoir 148 of FIG. 1, which is fluidly connected to the inlet port 356. The treatment fluid flows into the internal reservoir 352 and is forced through the treatment fluid channels 348 and apertures 328 by the pressure in the treatment fluid, spilling onto the surface 332 of the faceplate 320. The treatment fluid is then spread evenly across the surface 332 and the ink apertures 324 in the surface by, for example, a wiper blade such as the wiper blade 124 of FIG. 1. In other embodiments, alternative mechanisms for spreading the surface treatment fluid across the surface of the faceplate can be used, for example, a woven or fabric pad or a sponge. Although the illustrated embodiments depict a printhead configured to eject horizontally, the reader should appreciate that the system described above also applies to printheads that eject ink in other orientations, for example, downwardly facing printheads. In such printheads, even though gravity acts to urge both the treatment fluid and ink to fall away from the faceplate, the high surface tension of the fluid and ink result in a quantity of the fluid and ink adhering to the printhead faceplate. Wiping the printhead face with the wiper blade performs the same function of spreading, smoothing and cleaning both the treatment fluid and the ink on the surface of the faceplate.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a printhead including:

a faceplate having a first plurality of apertures formed in the faceplate and a second plurality of apertures formed in the faceplate, the first plurality of apertures being in a first contiguous area of the faceplate that is outside of a second contiguous area in which the second plurality of apertures is located and the first plurality of apertures and the second plurality of apertures extend parallel to one another in a cross-process direction across the printhead;

a jet stack having a first plurality of channels and a second plurality of channels, the first plurality of channels being fluidly and independently connected to the first plurality of apertures in the faceplate in a one-to-one correspondence, and the second plurality of channels being fluidly and independently connected to the second plurality of apertures in the faceplate, each of the channels in the second plurality of channels having an inkjet ejector configured to eject a fluid through the aperture fluidly connected to the channel associated with the inkjet ejector, and none of the channels in the first plurality of channels having an inkjet ejector;

a pressure source fluidly connected to each of the channels in the first plurality of channels; and a controller operatively connected to the pressure source, the controller being configured to operate the pressure source selectively to move fluid through the first plurality of channels and out of the first plurality of apertures to place fluid on the faceplate at a position in the first contiguous area that enables the fluid to move into the second contiguous area to flow over each aperture in the second plurality of apertures.

2. The printer of claim 1 further comprising:

a wiper configured to wipe the faceplate to spread the fluid on the faceplate; and the controller being operatively connected to the wiper and configured to operate the wiper to wipe the faceplate after operating the pressure source to place fluid on the faceplate.

3. The printer of claim 2, the wiper being configured to wipe the first contiguous area of the faceplate before wiping the second contiguous area of the faceplate.

4. The printer of claim 1 further comprising:

a first reservoir fluidly connected to the first plurality of channels; and a second reservoir fluidly connected to the second plurality of channels.

5. The printer of claim 1 wherein the apertures in the first plurality of apertures have a diameter that is different than a diameter of the apertures in the second plurality of apertures.

6. The printer of claim 1, wherein the pressure source is external to the printhead.

7. The printer of claim 1 wherein the first plurality of apertures are arranged in a cross-process direction across the faceplate and the second plurality of apertures are arranged in the second contiguous area in a plurality of rows that are parallel to the cross-process direction and the first plurality of apertures in the first contiguous area.

8. An in situ method of maintaining a printhead comprising:

expelling a first fluid from a first plurality of apertures formed in a faceplate of the printhead in a first area of the faceplate of the printhead to place the first fluid on the first area of the faceplate of the printhead, none of the apertures in the first plurality of apertures being associated with an inkjet ejector; and wiping the faceplate to spread the first fluid across a second area of the faceplate, which is outside the first area and in which a second plurality of apertures are positioned so the first plurality of apertures and the second plurality of apertures are parallel in a cross-process direction across the printhead, the second plurality of apertures being fluidly connected to a source of a second fluid, which is different than the first fluid, and each of the apertures in the second plurality of apertures being independently configured with an inkjet ejector to eject the second fluid.

9. The in situ method of claim 8, the expelling of the first fluid further comprising:

applying pneumatic pressure to the first fluid to urge the first fluid out of the apertures of the first plurality of apertures.

10. The in situ method of claim 8, the expelling of the first fluid further comprising:

expelling silicone oil onto the faceplate of the printhead; and the second apertures are configured with the inkjet ejectors to eject ink through the apertures.

* * * * *